United States Patent [19]

Dickert, Jr.

[11] 3,935,122

[45] Jan. 27, 1976

[54] GREASE COMPOSITIONS

[75] Inventor: Joseph J. Dickert, Jr., Lower Makefield Township, Pa.

[73] Assignee: Mobil Oil Corporation, New York, N.Y.

[22] Filed: Apr. 1, 1975

[21] Appl. No.: 563,997

[52] U.S. Cl. ..... 252/33.2; 252/35; 252/39

[51] Int. Cl.[2]. C10M 1/40; C10M 3/34; C10M 5/22; C10M 7/38

[58] Field of Search..... 252/33.2, 35, 39

[56] References Cited

UNITED STATES PATENTS

| | | | |
|---|---|---|---|
| 3,684,726 | 8/1972 | Haak et al. | 252/33.2 |
| 3,766,068 | 10/1973 | Tesdahl et al. | 252/33.2 |
| 3,809,649 | 5/1974 | VanDoorne | 252/33.2 |

*Primary Examiner*—Delbert E. Gantz
*Assistant Examiner*—I. Vaughn
*Attorney, Agent, or Firm*—Charles A. Huggett; Raymond W. Barclay; Benjamin I. Kaufman

[57] ABSTRACT

Grease compositions are provided comprising a major proportion of an oil of lubricating viscosity and a thickening amount of a metal salt of a C-alkyl or alkenyl succinic acid, having from about 10 to about 30 carbon atoms in the alkyl or alkenyl group, and a metal salt of a C-alkyl or alkenyl succoinoamidoarylsulfonic acid, having from about 14 to about 30 carbon atoms in the alkyl or alkenyl group.

13 Claims, No Drawings

GREASE COMPOSITIONS

BACKGROUND OF THE INVENTION

1. Field of the Invention

This invention relates to grease compositions and relates more particularly to grease compositions containing, as thickening agents, metal salts of C-alkyl or alkenyl succinic acids, having from about 10 to about 30 carbon atoms in the alkyl or alkenyl group, and metal salts of C-alkyl or alkenyl succinomidoarylsulfonic acids, having from about 14 to about 30 carbon atoms in the alkyl or alkenyl group.

2. Description of the Prior Art

The prior art has, heretofore, provided grease formulations containing various types of thickening agents, particularly greases thickened with animal or plant-derived fatty acid salts or modified clays. It is found, however, that such thickening agents often fail to provide the complete range of thickening desired in commercial greases, where the grease must undergo widely varying temperature changes during the course of operating conditions. The use of C-alkyl or alkenyl succinimidoarylsulfonic acids, as thickening agents, has also been proposed, resulting in greases which can perform their function over a wide temperature range, and disclosed in co-pending Application Ser. No. 507,024, filed Sept. 18, 1974.

SUMMARY OF THE INVENTION

In accordance with the present invention, there are provided improved grease compositions comprising a major proportion of an oil of lubricating viscosity and a thickening amount of each of a metal salt of a C-alkyl or alkenyl succinic acid, having from about 10 to about 30 carbon atoms in the alkyl or alkenyl group and a metal salt of a C-alkyl or alkenyl succinimidoarylsulfonidc acid, having from about 14 to about 30 carbon atoms in the alkyl or alkenyl group. The presence of each of these metal salts, as thickening agents, results in greases which can effectively perform their function over a wide temperature range, and are also effective in exhibiting highly improved stability properties with reference to separation and improved (higher) dropping point characteristics, as compared with the use of the thickeners of the prior art.

A critical requirement of the above-described metal salts, as thickening agents, is that the C-alkyl or alkenyl succinic acids have from about 10 to about 30 carbon atoms in the alkyl or alkenyl group, and that the C-alkyl or alkenyl succinimidoarylsulfonic acid have from about 14 to about 30 carbon atoms in the alkyl or alkenyl group. If each of the metal salts, contains less than the aforementioned lower limit number of carbon atoms, the resulting metal salts are found to be insoluble in the oil vehicle and are not sufficiently stable to perform satisfactorily under conditions of operation. On the other hand, if the alkyl or alkenyl group of each of the aforementioned metal salts contains more than about 30 carbon atoms, the resulting thickener becomes excessively soluble in the oil to such an extent that it cannot provide sufficient thickening power to obtain an effective grease.

Within the aforementioned limitations, various metal salts of C-alkyl or alkenyl succinimidoarylsulfonic acids, containing from about 14 to about 30 carbon atoms in the alkyl or alkenyl group may be effectively employed as thickening agents. Thus the salts may include salts of C-alkyl or alkenyl succinimidobenzenesulfonic acids or C-alkyl or alkenyl succinimidonaphthalenesulfonic acids, the sodium-lithium or sodium-aluminum salt C-n-octadecyl or octadecenyl succinimidonaphthalenedisulfonic acid, the sodium-calcium salt of C-n-octadecyl or octadecenyl succinimidohydroxybenzenesulfonic acid, the triethylamine salt of C-n-docosenylsuccinimidohydroxybenzenesulfonic acid, the sodium salts of C-n-docosenylsuccinimidohydroxybenzenesulfonic acid, or the lithium salt of C-n-docosenylsuccinimidohydroxybenzenesulfonic acid.

These salts of C-alkyl or alkenyl succinimidoarylsulfonic acids may be synthesized by commercially well-known methods, in oil solution. Many metals may be effectively employed for synthesizing the desired metal salt and particularly include alkali or alkaline earth metal salts represented by lithium, sodium, potassium, rubidium, cesium, calcium, strontium or barium.

The novel greases of the present invention, as hereinbefore noted, may be prepared in accordance with conventional grease manufacturing procedures, or by any mixing technique in which solid particles are wetted by a fluid. The manufacture of typical representative greases, in accordance with the invention, is illustrated by the procedures of the following examples.

In the above-described grease composition each of the metal salts may be present in an amount from about 1 to about 99%, by weight of the total weight of the salts. Particularly preferred are grease compositions wherein each of the metal salts is present in an amount from about 40 to about 60%, by weight of the total weight of the salts.

DESCRIPTION OF SPECIFIC EMBODIMENTS

EXAMPLE 1

Preparation of the Imide:

About 0.54 mole (189 g. based on assay by titration) of 7-Amino-1, 3-naphthalene disulfonic acid, monosodium salt, about 250 ml. water, about 80 ml. of triethylamine and about 1357 g. of 500'' solvent-refined naphthenic neutral base oil were mixed in an appropriate reactor under nitrogen. The mixture was stirred and heated slowly to about 150°C to form the amine salt, and to remove the excess amine and the water.

At about 150°C, about 223 g. (about 0.55 mole) of docosenylsuccinic anhydride was added to the reaction mixture. Stirring and heating at about 50°C was continued for 15 to 20 hours. At this time the infra-red spectrum of the reaction mixture showed a strong absorption for imide carbonyl group.

EXAMPLE 2

Mixed Calcium Salt Thickened Grease:

About 250 g. of the product from Example 1 (containing about 62-½ g., 0.077 mole of the imide in the aforementioned base oil of Example 1) 32 g., 0.091 mole of octadecenyl succinic anhydride, 96 g. of the aforementioned base-oil of Example 1, 9 g. (.116 mole) of 96% $Ca(OH)_2$ and 10 g. of water were mixed in a small, open, externally-heated reactor which was stirred by counter-rotating blades to insure good mixing. The stirring mixture was heated at 210°F ± 10° for about 15 minutes, then to about 400°F. After cooling to room temperature, the product was homogenized by two passes through a mill. The ASTM ½ scale penetration (worked 60 strokes) of this product was 71. The product was returned to the reactor, 150 g. of the aforementioned baseoil of Example 1 was added and then stirred and heated to about 400°F. After cooling to room temperature and two passes through the mill, the ASTM ½ scale penetration (worked 60 strokes) was 95. The solute concentration was about 18%.

About one-half of the product (265 g.) was removed from the reactor. To the remaining half, about 135 g. of the aforementioned base-oil of Example 1 stock was added. The mixture was stirred, heated to about 400°F, cooled and milled by two passes through the mill. (Solute concentration was then about 12%). The ASTM ½ scale penetration (worked 60 strokes) was 134. A full-scale ASTM penetration (worked 60 strokes) was 283.

EXAMPLE 3

Mixed Calcium Salt Thickened Grease:

About 250 g. of the product from Example 1 above (containing about 62½ g., 0.077 mole of the imide in the aforementioned base-oil), 23 g., 0.077 mole of tetradecenyl succinic anhydride, 60 g. of the base-oil, 9 g. (.116 mole) of 96% $Ca(OH)_2$ and 10 g. of water were mixed in a small, open, externally-heated reactor which was stirred by counterrotating blades to insure good mixing. The stirring mixture was heated at 210°F ± 10° for about 15 minutes, then to about 400°F. After cooling to room temperature, the product was homogenized by two passes through a mill. The ASTM ½ scale penetration (worked 60 strokes) of this product was 105. The product was returned to the reactor, 130 g. of the base-oil was added and then stirred and heated to about 400°F. After cooling to room temperature and two passes through a mill, the ASTM ½ scale penetration (worked 60 strokes) was 123. The solute concentration was about 18%. The "ASTM Dropping Point" was 609°F. The "oil separation at 300°F" was 1.9%.

About one-half of the product (230 g.) was removed from the reactor. To the remaining half, about 109 g. of the base-oil was added. The mixture was stirred, heated to about 400°F, cooled and milled by two passes through the mill. (Solute concentration was then about 12%). The ASTM ½ scale penetration (worked 60 strokes) was 210. The "ASTM Dropping Point" was 609°F. The "oil separation" at 300°F was 8.1%.

EXAMPLE 4

Mixed Aluminum Salt Thickened Grease:

About 250 g. of the product from Example 1 above (containing about 62½ g., .077 mole of the imide in base-oil, 32 g. (0.091 mole) of octadecenyl succinic anhydride, 100 g. base-oil, 21 g. (0.09 mole) of 98% aluminum isopropoxide were mixed in a small, open, externally-heated reactor which was stirred by counter-rotating blades to insure good mixing. The stirring mixture was heated at 210°F ± 10° for about 15 minutes, then to about 300°F. After cooling to room temperature, the product was homogenized by two passes through a mill. The ASTM ½ scale penetration (worked 60 strokes) of this product was 133. The product was returned to the reactor, 150 g. of base-oil was added and then stirred and heated to about 300°F. After cooling to room temperature and two passes through the mill, the ASTM ½ scale penetration (worked 60 strokes) was 185. The solute concentration was about 18%. The "ASTM Dropping Point" was >633°F. The "Oil Separation" at 300°F was 0.18%.

EXAMPLE 5

Mixed Calcium-Aluminum Salt Thickened Grease:

About 250 g. of the product from Example 1 above (containing about 62½ g., 0.077 mole of the imide in base-oil, 32 g., 0.091 mole of octadecenyl succinic anhydride, 100 g. base-oil, 9.1 g. aluminum isopropoxide and 5.9 g. of 96% Ca(OH) were mixed in a small, open, externally-heated reactor which was stirred by counter-rotating blades to insure good mixing. The stirring mixture was heated at 210°F ± 10°for about 15 minutes, then to about 300°F. After cooling to room temperature, the product was homogenized by two passes through a "Tri-Homo" mill. The ASTM ½ scale penetration (worked 60 strokes) of this product was 108. The product was returned to the reactor, 150 g. of base-oil was added and then stirred and heated to about 300°F. After cooling to room temperature and two passes through the "Tri-Homo" mill, the ASTM ½ scale penetration (worked 60 strokes) was 121. The solute concentration was about 17%. The "ASTM Dropping Point" was >633°F. The "Oil Separation" at 300°F was 0.5%.

About one-half of the product (264 g.) was removed from the reactor. To the remaining half, about 111 g. of 678 stock was added. The mixture was stirred, heated to about 300°F, cooled and milled by two passes through the "Tri-Homo" mill. (Solute concentration was then about 12%). The ASTM ½ scale penetration (worked 60 strokes) was 167. The "ASTM Dropping Point" was 598°F. The "Oil Separation" at 300°F was 5.8%.

EXAMPLE 6

Preparation of the Imide

About 0.54 mole (230 g) of the triethylamine salt of 7-amino-1, 3-naphthalene disulfonic acid monosodium salt and about 0.55 mole (223 g) of n-docosenyl-succinic anhydride and about 1360 g of the base-oil described in Example 1 were mixed in an appropriate reactor under nitrogen. The mixture was stirred and heated at about 150°C for 15 to 20 hours. The infra-red spectrum of the cooled reaction mixture showed a strong absorption for an imide carbonyl group.

EXAMPLE 7

Calcium Salt-thickened Grease:

About 0.15 moles (about 500 g of 25% of imide-oil solution) of the product from reaction described above was placed in a reactor. About 0.076 mole (6.1 g of 93%) $Ca(OH)_2$ and about 10 ml. of water were added.

The stirring mixture was heated to 420°F, cooled and then milled twice through a mill. After cooling to room temperature, the ½ scale ASTM penetration (worked 60 strokes) was 101.

The mixture was returned to the reactor, 50 ml. $H_2O$ was added and heated, with stirring again to about 400°F. After cooling to room temperature and milling twice in the mill the ½ scale ASTM penetration at room temperature (worked 60 strokes) was 108.

The product was returned to the reactor, 150 g. of the base-oil was added and it was again heated with stirring to 400°F. After cooling and milling as before the ½ scale ASTM penetration (worked 60 strokes) was 136. The solute concentration was about 17–18%.

The dropping point (ASTM D2265) was 601°F and the oil separation at 300°F (F321) was 3.08%.

EXAMPLE 8

Mixed Calcium Salt Thickened Grease:

About 250 g. of the product from Example 1 (containing about 62-½ g., 0.077 mole of the imide) in the aforementioned base-oil, 32 g., 0.091 mole of octadecenyl succinic anhydride, 96 g. of the same base-oil, 9 g. (0.116 mole) of 96% $Ca(OH)_2$ and 10 g. of water were mixed in a small, open, externally-heated reactor which was stirred by counter-rotating blades to insure good mixing. The stirring mixture was heated at 210°F ± 10° for about 15 minutes, then to about 400°F. After cooling to room temperature, the product was homogenized by two passes through a mill. The ASTM ½ scale penetration (worked 60 strokes) of this product was 71. The product was returned to the reactor, 150 g. of base-oil was added and then stirred and heated to about 400°F. After cooling to room temperature and two passes through the mill, the ASTM ½ scale penetration (worked 60 strokes) was 95. The solute concentration was about 17–18%.

The dropping point (ASTM D2265) was 623°F and the oil separation at 300°F (F321) was 0.26%.

It is to be understood that the foregoing description is merely illustrative of preferred embodiments of the invention of which many variations may be made by those skilled in the art within the scope of the following claims without departing from the spirit thereof.

I claim:

1. A grease composition comprising a major proportion of an oil of lubricating viscosity and an amount of metal salts sufficient to thicken said oil to a grease consistency, which salts consist essentially of (a) at least one metal salt of a C-alkyl or alkenyl succinic acid, having from about 10 to about 30 carbon atoms in the alkyl or alkenyl group and (b), at least one metal salt of a C-alkyl or alkenyl succinimidoarylsulfonic acid, having from about 14 to about 30 carbon atoms in the alkyl or alkenyl group, the relative weight proportions of (a) to (b) being between 1:99 and 99:1.

2. The grease composition of claim 1 wherein said relative weight proportion of (a) and (b) are between about 60:40 and about 40:60.

3. The grease composition of claim 1 wherein the metal salt of the C-alkyl or alkenyl succinic acid is the calcium salt of octadecenyl succinic acid.

4. The grease composition of claim 1 wherein the metal salt of the C-alkyl or alkenyl succinic acid is the aluminum salt of octadecenyl succinic acid.

5. The grease composition of claim 1 wherein the metal salt of the C-alkyl or alkenyl succinic acid is the calcium salt of tetradecenyl succinic acid.

6. The grease composition of claim 1 wherein the metal salt of the C-alkyl or alkenyl succinimidoarylsulfonic acid is a metal salt of a C-alkyl or alkenyl succinimidobenzene sulfonic acid.

7. The grease composition of claim 1 wherein the metal salt of the C-alkyl or alkenyl succinimidoarylsulfonic acid is a metal salt of a C-alkyl or alkenyl succinimidonaphthalenesulfonic acid.

8. The grease composition of claim 1 wherein the metal salt of the C-alkyl or alkenyl succinimidoarylsulfonic acid is the sodium-lithium salt of C-n-octadecylsuccinimidonaphthalenedisulfonic acid.

9. The grease composition of claim 1 wherein the metal salt of the C-alkyl or alkenyl succinimidoarylsulfonic acid is the sodium-calcium salt of C-n-octadecylsuccinimidohydroxybenzenesulfonic acid.

10. The grease composition of claim 1 wherein the salt of the C-alkyl or alkenyl succinimidoarylsulfonic acid is the triethylamine salt of C-n-docosenylsuccinimidohydroxybenzenesulfonic acid.

11. The grease composition of claim 1 wherein the metal salt of the C-alkyl or alkenyl succinimidoarylsulfonic acid is the sodium salt of C-n-docosenylsuccinimidorhydroxybenzenesulfonic acid.

12. The grease composition of claim 1 wherein the metal salt of the C-alkyl or alkenyl succinimidoarylsulfonic acid is the lithium salt of C-n-docosenylsuccinimidohydroxybenzenesulfonic acid.

13. The grease composition of claim 1 wherein the thickener comprise a combination of the calcium-sodium salt of C-n-docosenylsuccinimidonaphthalenedisulfonic acid and the calcium salt of C-n-octadecenylsuccinic acid.

* * * * *

UNITED STATES PATENT OFFICE

CERTIFICATE OF CORRECTION

Patent No. 3,935,122 Dated January 27, 1976

Inventor(s) Joseph J. Dickert, Jr.

It is certified that error appears in the above-identified patent and that said Letters Patent are hereby corrected as shown below:

Abstract, lines 6-7, "succoinoamidoarylsulfonic" should read -- succinimidoarylsulfonic --.

Column 2, line 49, "50°C" should read -- 150° C --.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*